US012070125B2

(12) United States Patent
Klosky

(10) Patent No.: US 12,070,125 B2
(45) **Date of Patent: *Aug. 27, 2024**

(54) ALBUM HOLDER

(71) Applicant: IdeaStream Consumer Products, LLC, Cleveland, OH (US)

(72) Inventor: Eric Fitzgerald Klosky, Chagrin Falls, OH (US)

(73) Assignee: Ideastream Consumer Products, LLC, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/216,065

(22) Filed: Jun. 29, 2023

(65) Prior Publication Data

US 2023/0337819 A1 Oct. 26, 2023

Related U.S. Application Data

(63) Continuation of application No. 17/858,245, filed on Jul. 6, 2022, now Pat. No. 11,723,462, which is a continuation-in-part of application No. 29/783,937, filed on May 17, 2021, now Pat. No. Des. 996,851.

(60) Provisional application No. 63/218,702, filed on Jul. 6, 2021.

(51) Int. Cl.
*A47B 81/06* (2006.01)

(52) U.S. Cl.
CPC ..... *A47B 81/067* (2013.01)

(58) Field of Classification Search
CPC ..... G11B 23/0236; G11B 33/0461; G11B 33/0433; G11B 33/0483; G11B 33/0472; G11B 33/0444; G11B 33/0455; A47B 81/067; A47B 81/068
USPC ..... 211/41.1, 41.2, 40
See application file for complete search history.

(56) References Cited

U.S. PATENT DOCUMENTS 1,402,332 A * 1/1922 Wiehl ..... G11B 33/0444
1,480,939 A * 1/1924 Hand ..... G11B 33/0444
1,660,210 A * 2/1928 Schaefer ..... A47F 7/0064 211/41.2
2,895,619 A * 7/1959 Frazier ..... A47B 57/404 403/345
3,712,477 A * 1/1973 Kieves ..... B42F 17/02
4,566,839 A * 1/1986 Butler ..... H01L 21/67313 211/41.18
4,629,067 A * 12/1986 Pavlik ..... G11B 33/0433 211/41.12
4,781,292 A * 11/1988 Sacherman ..... G11B 23/0236 211/40
4,781,423 A * 11/1988 Muenzer ..... G11B 23/0236 220/555
5,005,708 A * 4/1991 Posso ..... G11B 33/0455 312/9.58
5,078,270 A * 1/1992 Campbell ..... G11B 33/0483 211/41.12
5,111,940 A * 5/1992 VanNoord ..... G11B 23/0236 211/40
5,115,919 A * 5/1992 Dorman ..... B42F 17/12 211/DIG. 1
5,117,984 A * 6/1992 Kennedy ..... G11B 33/0483 211/40
5,346,074 A * 9/1994 Overholser ..... G11B 33/0438 312/9.9

(Continued)

*Primary Examiner* — Patrick D Hawn
(74) *Attorney, Agent, or Firm* — Dickinson Wright PLLC

(57) ABSTRACT

A storage device for holding record albums.

15 Claims, 10 Drawing Sheets

FIG. 1

(56) References Cited

U.S. PATENT DOCUMENTS 5,346,078 A * 9/1994 Ernetoft ..... A47F 7/0007 211/90.01
5,383,722 A * 1/1995 Chen ..... A47B 81/068 312/348.3
5,558,235 A * 9/1996 Hunt ..... G11B 33/0461 312/348.3
5,597,216 A * 1/1997 Real ..... G11B 23/0236 312/351
5,704,494 A * 1/1998 Nishikiori ..... B65D 25/107 211/41.18
5,794,796 A * 8/1998 Weisburn ..... G11B 33/0461 312/348.3
5,823,332 A * 10/1998 Clausen ..... G11B 33/0433 211/41.12
5,833,062 A * 11/1998 Yeh ..... G11B 33/0472 211/40
D405,115 S * 2/1999 Stravitz ..... D19/86
5,934,463 A * 8/1999 Yu ..... G11B 33/0438 211/41.12
5,971,164 A * 10/1999 Wong ..... B65D 25/107 211/40
6,039,190 A * 3/2000 Clausen ..... G11B 23/0236 211/41.12
6,073,764 A * 6/2000 Haas ..... G11B 33/0438 211/41.12
6,161,704 A * 12/2000 Stravitz ..... B42F 17/02 211/189
6,189,711 B1 * 2/2001 Chang ..... B43M 99/00 211/11
6,308,839 B1 * 10/2001 Steinberg ..... G11B 33/0461 211/184
6,332,546 B1 * 12/2001 Hunt ..... B42F 17/08 211/41.12
6,340,086 B1 * 1/2002 McConnaughy .. G11B 33/0433 211/41.12
6,739,451 B2 * 5/2004 Mateus ..... G11B 33/0472 211/41.12
6,758,346 B2 * 7/2004 Kollegian ..... G11B 33/0472 312/9.9
D505,285 S * 5/2005 Hunt ..... D6/629
D509,982 S * 9/2005 Yang ..... D6/629
7,044,310 B2 * 5/2006 Yi ..... G11B 33/0455 211/40
7,228,974 B2 * 6/2007 Ohayon ..... G11B 33/0433
11,089,869 B2 * 8/2021 Robinson ..... A47B 81/067
D961,299 S * 8/2022 Chiang ..... D6/629
2004/0022607 A1 * 2/2004 Lim ..... H01L 21/67313 211/41.18
2004/0065629 A1 * 4/2004 Hunt ..... G11B 33/0466 211/184
2005/0269221 A1 * 12/2005 Demeaux ..... G11B 33/0472 211/41.12
2007/0125726 A1 * 6/2007 Seo ..... H01L 21/67028 211/41.18
2008/0083679 A1 * 4/2008 Watts ..... A47B 87/0276 211/41.12
2008/0142457 A1 * 6/2008 Chih-Min ..... G06F 1/183 211/41.12

* cited by examiner

ALBUM HOLDER

The present disclosure is a continuation of U.S. patent application Ser. No. 17/858,245 filed Jul. 6, 2022, which in turn claims priority on U.S. Provisional Patent Application Ser. No. 63/218,702 filed Jul. 6, 2021, which are fully incorporated by reference herein.

The present disclosure is a continuation of U.S. patent application Ser. No. 17/858,245 filed Jul. 6, 2022, which in turn is a continuation-in-part of U.S. patent application Ser. No. 29/783,937 filed May 17, 2021, which are fully incorporated by reference herein.

FIELD OF THE DISCLOSURE

The present disclosure relates generally to storage devices and more particularly to album holders.

BACKGROUND OF THE DISCLOSURE

Vinyl music albums have regained popularity in recent years. Common holders for CDs and DVDs cannot be used to effectively hold these vinyl albums. As such, there is a need for a holder that can easily and effectively hold vinyl albums.

SUMMARY OF DISCLOSURE

The present disclosure relates generally to storage devices and more particularly to album holders. The album holder in accordance with the present disclosure is configured to facilitate in the storage of record albums. The size of the record album that can be stored on the album holder is non-limiting.

In one non-limiting aspect of the present disclosure, there is provided an album holder that includes two base legs, and front and back panels that are also optionally generally have a similarly configured. The two base legs can optionally have a generally similar configuration; however, this is not required. The front and back panels can optionally have a generally similar configuration; however, this is not required. A connection arrangement (e.g., screw, adhesive, clamp, pin, hook and loop fastener, snap, etc.) can optionally be used to secure one or both panels to the base legs. The material that is used to form the base legs and/or panels is non-limiting (e.g., plastic, metal, wood, ceramic, composite material, glass, etc.). The album holder in accordance with the present disclosure is configured to hold a plurality of albums. The album holder can optionally be configured such that the albums can be easily moved or pivoted from one end to the other end of the album holder so as to allow a user to view the albums as the user leafs through the albums on the album holder.

In another non-limiting aspect of the present disclosure, the album holder in accordance with the present disclosure includes two base legs that have a generally similar configuration. Each of the base legs includes a front and back end portion and a middle portion. The front and back end portions each include an inner panel faces that is adapted to support a portion of a back side of the front or back panels. In one non-limiting embodiment, each of the two base legs includes a front panel slot that is located between the inner panel face on the front end portion of the base leg and the middle portion of the base leg. The front panel slot is configured to receive a base portion of the front panel. In another non-limiting embodiment, each of the two base legs includes a back panel slot is located between the inner panel face on the back end portion of the base leg and the middle portion of the base leg. The back panel slot is configured to receive a base portion of the back panel.

In another non-limiting aspect of the present disclosure, the album holder in accordance with the present disclosure the connection arrangement includes the use of one or more screws used to secure one or both of the two panels to the base legs. In one non-limiting embodiment, one or both of the panels can optionally include one or more preformed connector openings to facilitate in at least partially feeding a screw or other type of connection arrangement through the one or more preformed connector openings on one or both of the panels. In another non-limiting embodiment, one or both of the base legs can optionally include one or more preformed base openings facilitate in feeding a screw or other type of connection arrangement into the one or more preformed openings of the base legs. In one non-limiting configuration, one or more screw or other type of connection arrangements are first partially fed through the one or more preformed connector openings in one or both panels and then partially fed into one or more preformed base openings on one or both base legs to secure one or both panels to one or both the base legs.

In another non-limiting aspect of the present disclosure, the album holder in accordance with the present disclosure includes panels wherein the inner panel face of each of the panels extends upwardly from the middle portion of the base legs when the panels are connected to the base legs. The plane of the inner panel face of each of the panels relative to the plane of the bottom surface of the base legs when the panels are connected to the base legs is generally 20-90° (and all values and ranges therebetween). In one non-limiting embodiment, plane of the inner panel face of each of the panels relative to the plane of the bottom surface of the base legs when the panels are connected to the base legs is 30-75°. The plane of the inner panel face of each of the two panels relative to the plane of the bottom of the base legs can be the same or different. In another non-limiting embodiment, plane of the inner panel face of each of the two panels relative to the plane of the bottom of the base legs is generally the same.

In another non-limiting aspect of the present disclosure, the album holder in accordance with the present disclosure includes base legs wherein the top surface of one or both of the base legs can optionally include one or more slots or ribs or the like, so as to inhibit or prevent the bottom surface of the one or more albums on the album holder from freely sliding along the top surface of one or both of the base legs. The number of slots or ribs or the like on one or both of the base legs is non-limiting. The spacing of adjacently positioned slots or ribs or the like on one of both the base legs along the longitudinal length of the base legs can be the same or different. In one non-limiting embodiment, both of the base legs have the same number and same configuration of slots or ribs or the like. In another non-limiting embodiment, both of the base legs has the same shape, size and configuration. In another non-limiting embodiment, both panels have the same shape, size and configuration.

In another non-limiting aspect of the present disclosure, the album holder in accordance with the present disclosure includes base legs wherein one or both of the base legs optionally include one or more reinforcement structures to provide strength and rigidity to the base legs.

In another non-limiting aspect of the present disclosure, the album holder in accordance with the present disclosure includes panels wherein one or both of the panels have a generally square or rectangular shape.

In another non-limiting aspect of the present disclosure, the album holder in accordance with the present disclosure includes panels wherein one or both of the panels is optionally semi-opaque or clear.

In another non-limiting aspect of the present disclosure, the album holder in accordance with the present disclosure includes base legs wherein the base legs are spaced from one another when the album holder is fully assembled.

In another non-limiting aspect of the present disclosure, the album holder in accordance with the present disclosure includes base legs wherein the base legs wherein one or both base legs optionally include an anti-scratch and/or gripping arrangement on a bottom surface on one or both base legs. In one non-limiting embodiment, the anti-scratch and/or gripping arrangement can include one or more pads (e.g., felt pads, etc.) that are position on a portion or all of the bottom surface of the one or both base legs. The anti-scratch and/or gripping arrangement can be secured to the bottom surface of one or both base legs by an adhesive, melted connection, hook and loop fastener, or by some other mechanical connection arrangement.

One non-limiting object of the present disclosure is the provision of an album holder comprising a) first and second base legs; wherein each of the first and second base legs includes a front end section, a back end section and a mid-section positioned between the front end section and a back end section; and wherein a top surface of the mid-section optionally including a plurality of ribs; b) front and back panels; and c) an optional connection arrangement to secure the front and back panels to the first and second base legs; and wherein a front face of the front panel optionally angles away from a front face of the back panel when the front and back panels are connected to the first and second base legs; and wherein at least a portion of a back face of the front panel optionally contacting at least a portion of a front face of the front end section of each of the first and second base legs; and wherein at least a portion of a back face of the back panel optionally contacting at least a portion of a front face of the back end section of each of the first and second base legs.

Another non-limiting object of the present disclosure is the provision of an album holder wherein each of the first and second base legs optionally includes one or more reinforcement structures.

Another non-limiting object of the present disclosure is the provision of an album holder wherein the mid-section optionally includes one or more reinforcement structures.

Another non-limiting object of the present disclosure is the provision of an album holder wherein a front face of the back panel optionally angles away from a front face of the front panel when the front and back panels are connected to the first and second base legs.

Another non-limiting object of the present disclosure is the provision of an album holder wherein each of the first and second base legs optionally includes preformed base openings in a front face of each of the front end sections and/or the back end section of each of the first and second base legs.

Another non-limiting object of the present disclosure is the provision of an album holder wherein the first and second base legs are optionally spaced from one another when the front and back panels are connected to the first and second base legs.

Another non-limiting object of the present disclosure is the provision of an album holder wherein the first and second base legs each optionally include a front panel mount slot and a back panel mount slot; and wherein the front panel mount slot and the back panel mount slot are each configured to receive a portion of a bottom region of the front and back panels when the front and back panels are being connected to the first and second base legs.

Another non-limiting object of the present disclosure is the provision of an album holder wherein a side profile of the front panel mount slot and/or the back panel mount slot is optionally generally U-shaped.

Another non-limiting object of the present disclosure is the provision of an album holder wherein a thickness of each of the front panel mount slot and/or the back panel mount slot is optionally the same or slightly greater than a thickness of a bottom region of the front and back panels that is positioned in the front panel mount slot and the back panel mount slot.

Another non-limiting object of the present disclosure is the provision of an album holder wherein each of the front panel mount slot and said back panel mount slot optionally extends below a top surface of the mid-section.

Another non-limiting object of the present disclosure is the provision of an album holder wherein a longitudinal length of the mid-section of each of the first and second base legs is optionally greater than a longitudinal length of each of the front end sections and the back end sections.

Another non-limiting object of the present disclosure is the provision of an album holder wherein maximum height of the mid sections of each of the first and second base legs is optionally less than a maximum height of each of the front end sections and the back end sections.

Another non-limiting object of the present disclosure is the provision of an album holder wherein a front face of each of the front end sections and the back end sections optionally angle rearwardly from the mid sections.

Another non-limiting object of the present disclosure is the provision of an album holder wherein each of the front and back panels optionally include a plurality of preformed connector openings; and wherein each of the preformed connector openings are optionally spaced from a bottom edge of the front and back panels.

Another non-limiting object of the present disclosure is the provision of an album holder wherein a bottom surface each of the first and second base legs includes a pad; wherein the pad can optionally be used be to a) inhibit or prevent the bottom surface of the first and second base legs from scratching a surface that the first and second base legs are placed upon, and/or b) inhibiting or preventing the bottom surface of the first and second base legs from moving or sliding on a surface that the first and second base legs are were placed upon.

These and other objects and advantages will become apparent from the discussion of the distinction between the disclosure and the prior art and when considering the non-limiting embodiment illustrated in the accompanying drawings.

BRIEF DESCRIPTION OF THE DRAWINGS

Reference may now be made to the drawings, which illustrate various embodiments that the disclosure may take in physical form and in certain parts and arrangements of parts wherein.

DETAILED DESCRIPTION OF A NON-LIMITING EMBODIMENT

Figure 1:
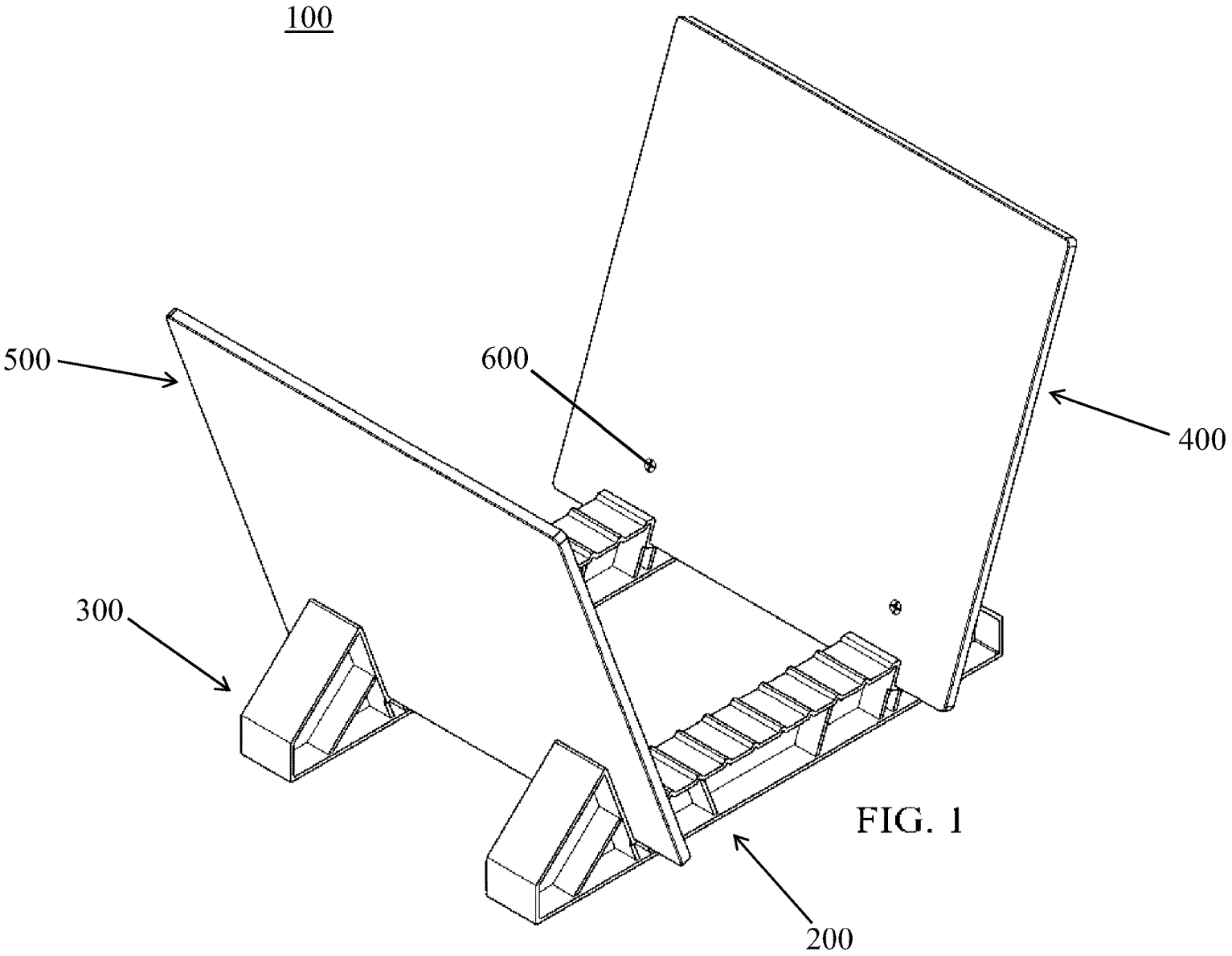
FIG. 1 is a front perspective view of the album holder in accordance with the present disclosure.
Figure 2:
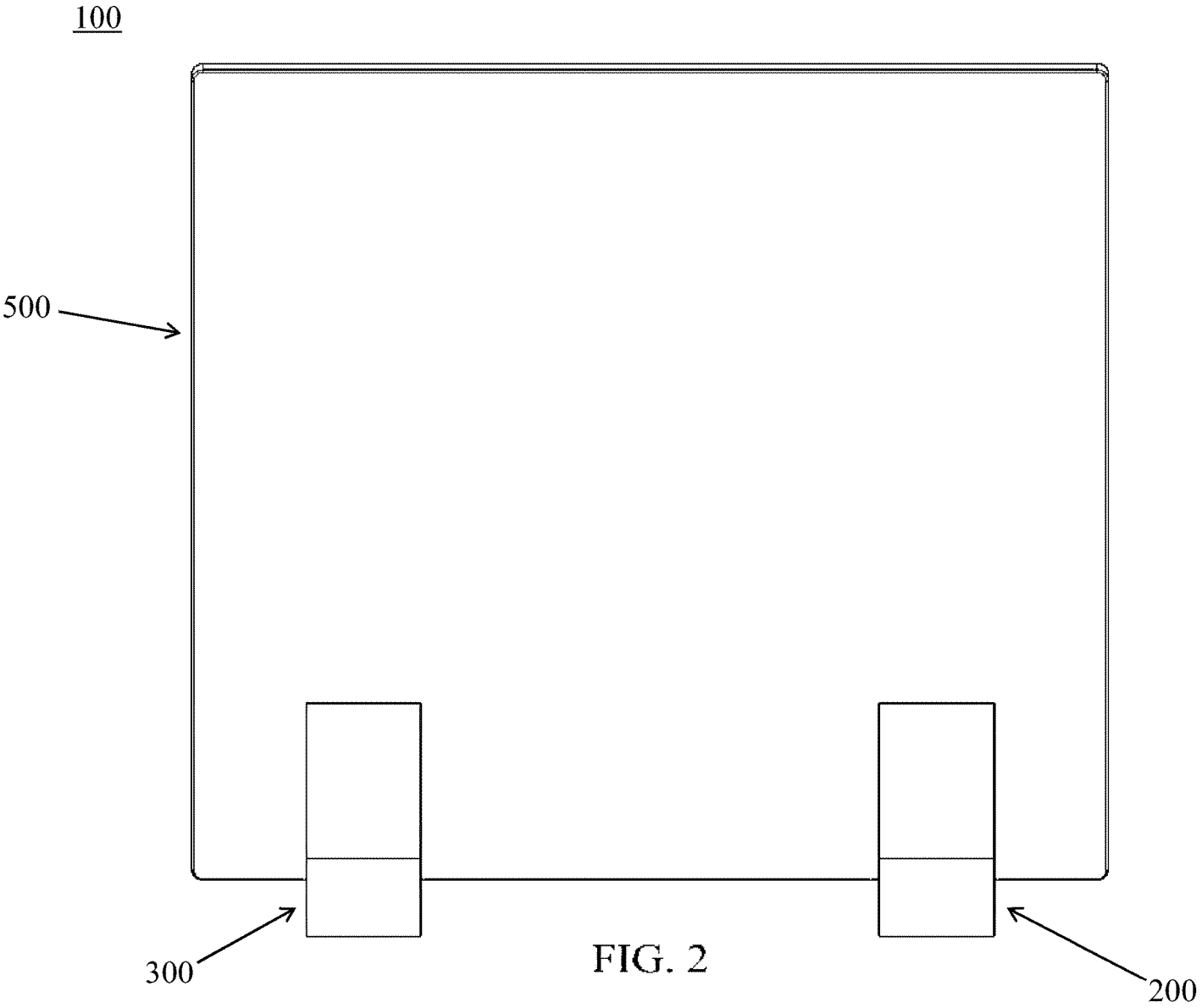
FIG. 2 is a front elevation view of the album holder of FIG. 1.
Figure 3:
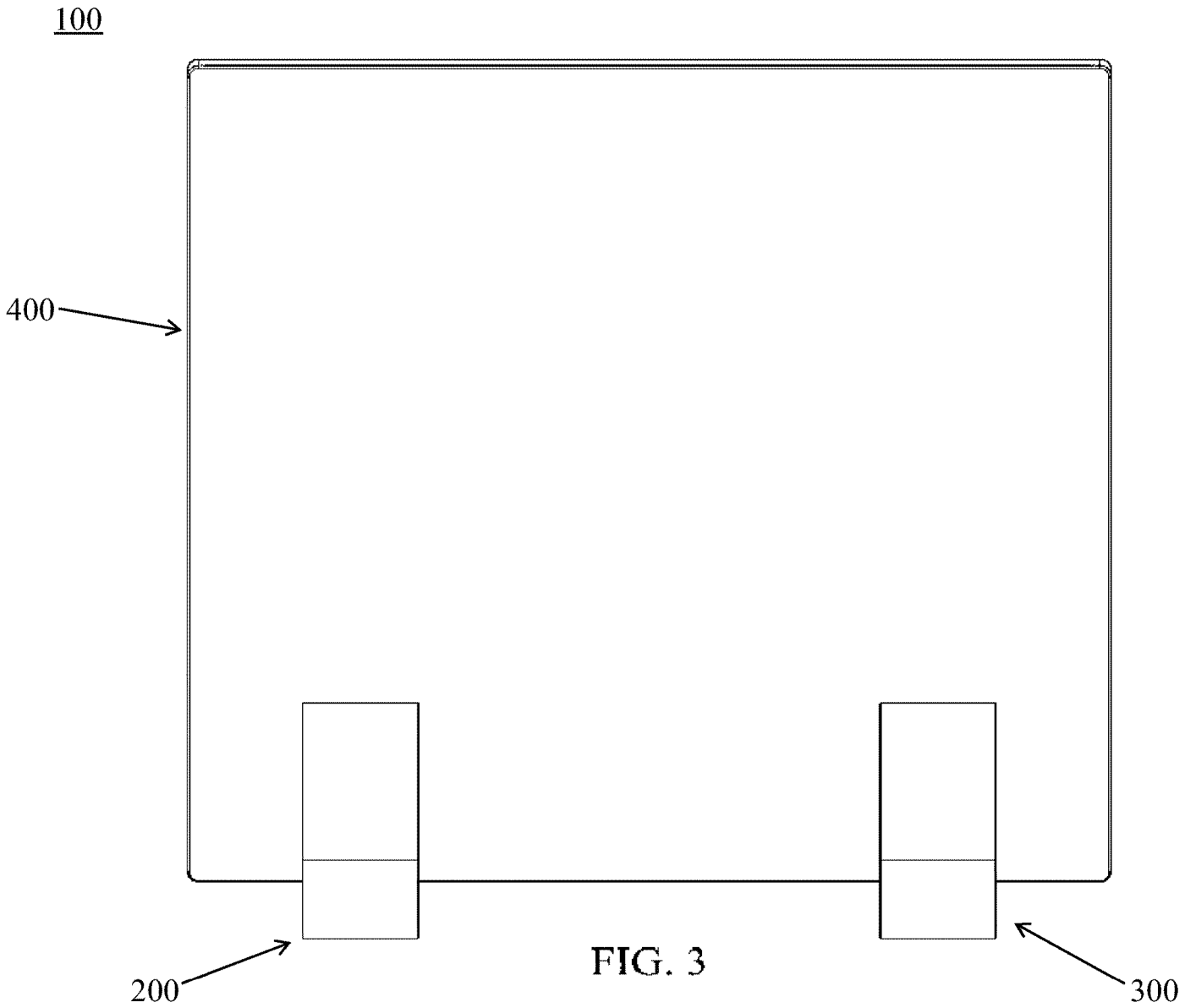
FIG. 3 is a rear elevation view of the album holder of FIG. 1.
Figure 4:
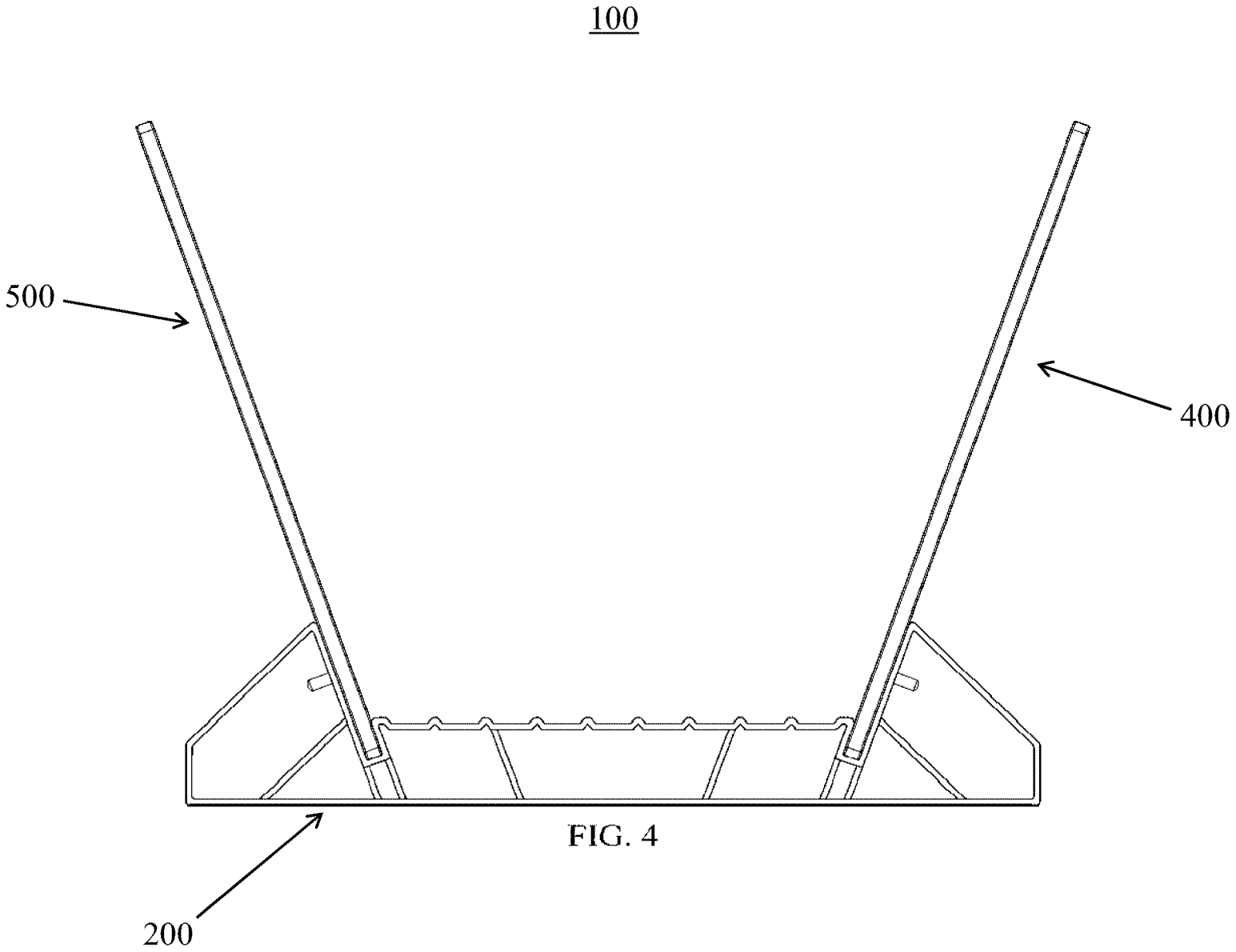
FIG. 4 is a right side plan view of the album holder of FIG. 1.
Figure 5:
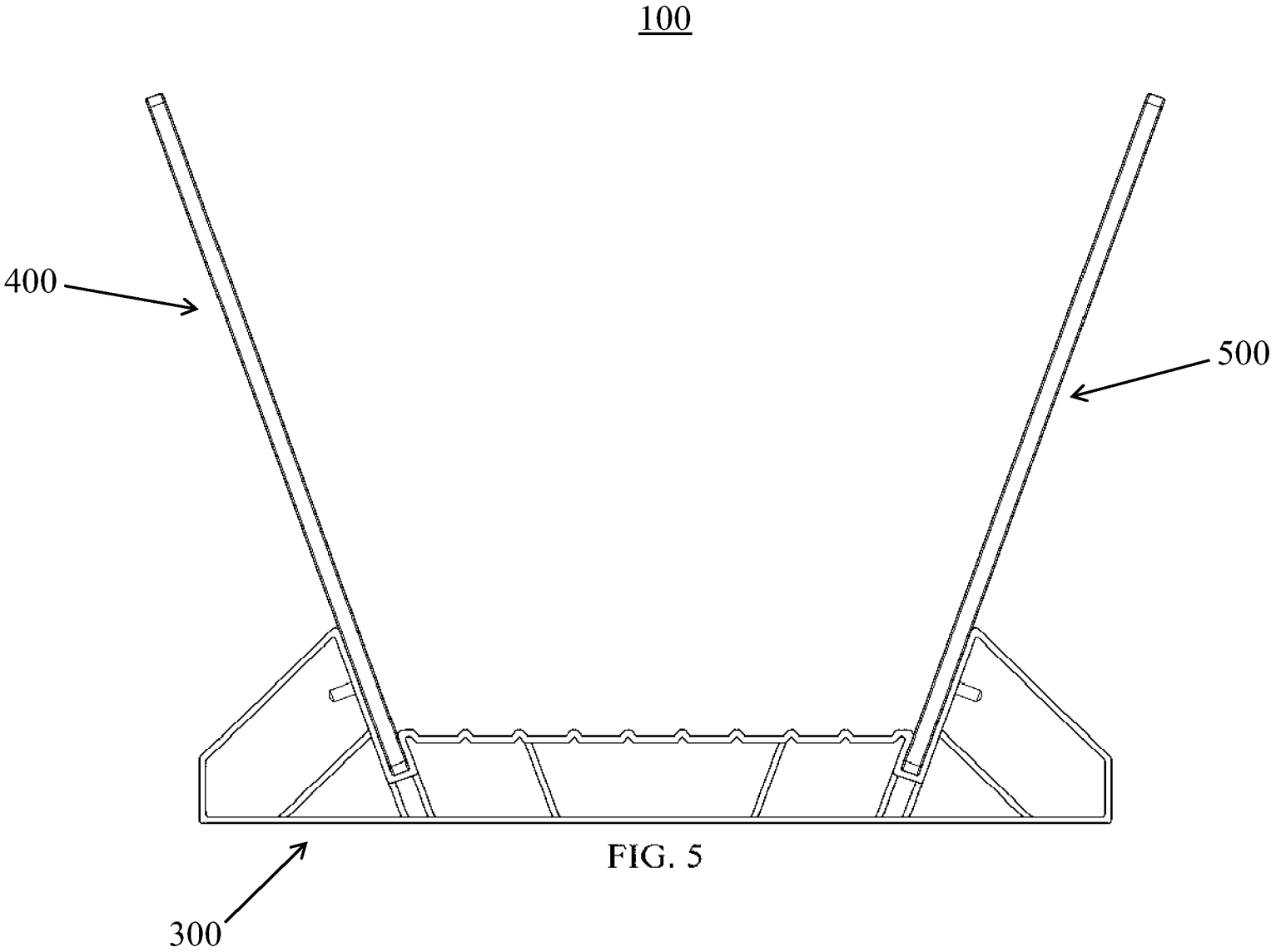
FIG. 5 a left side plan view of the album holder of FIG. 1.

A more complete understanding of the articles/devices, processes, and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

The figures illustrated an exemplary album holder 100 in accordance with the present disclosure.

Figure 8:
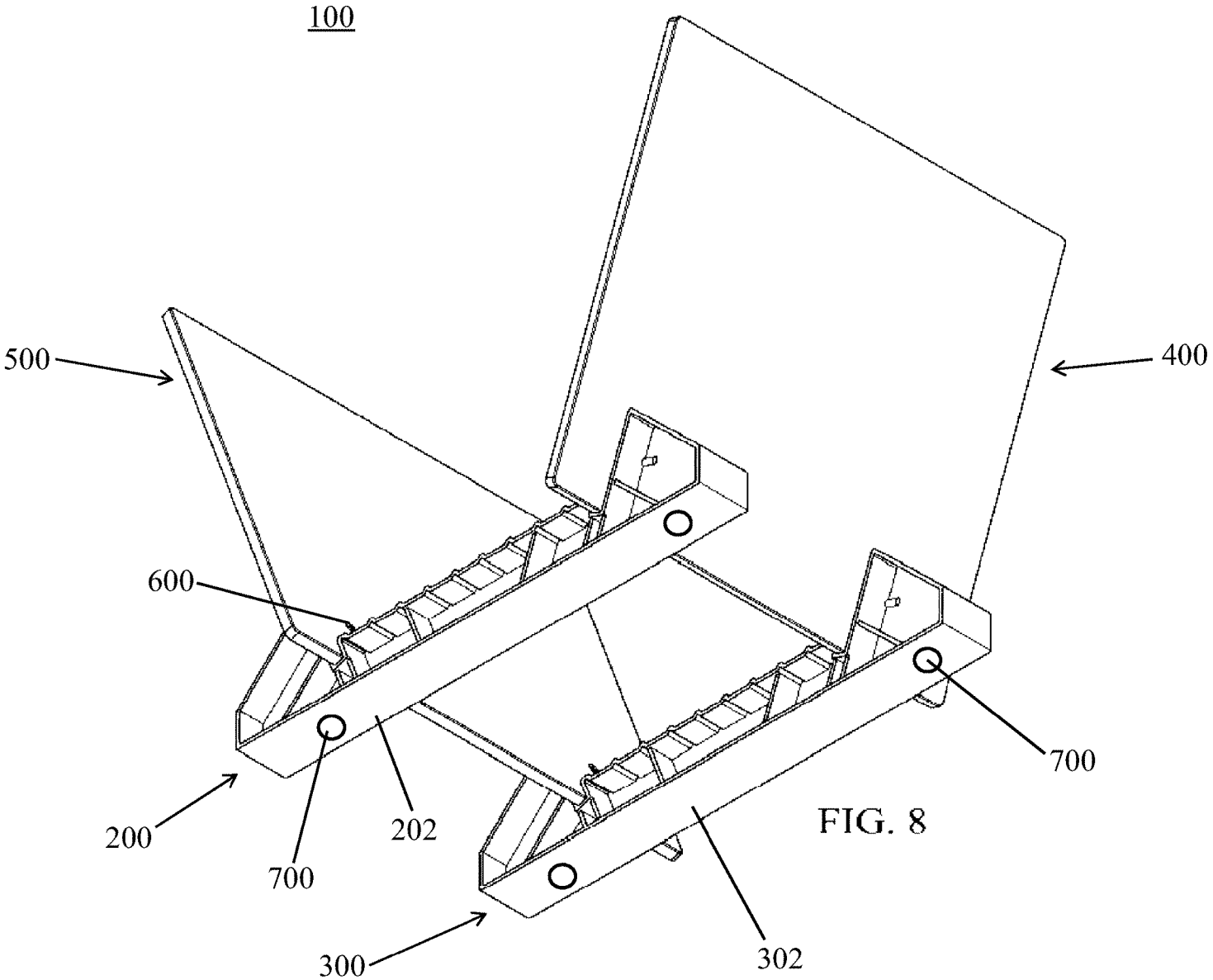
FIG. 8 is a bottom elevation view of the album holder of FIG. 1.
Figure 9:
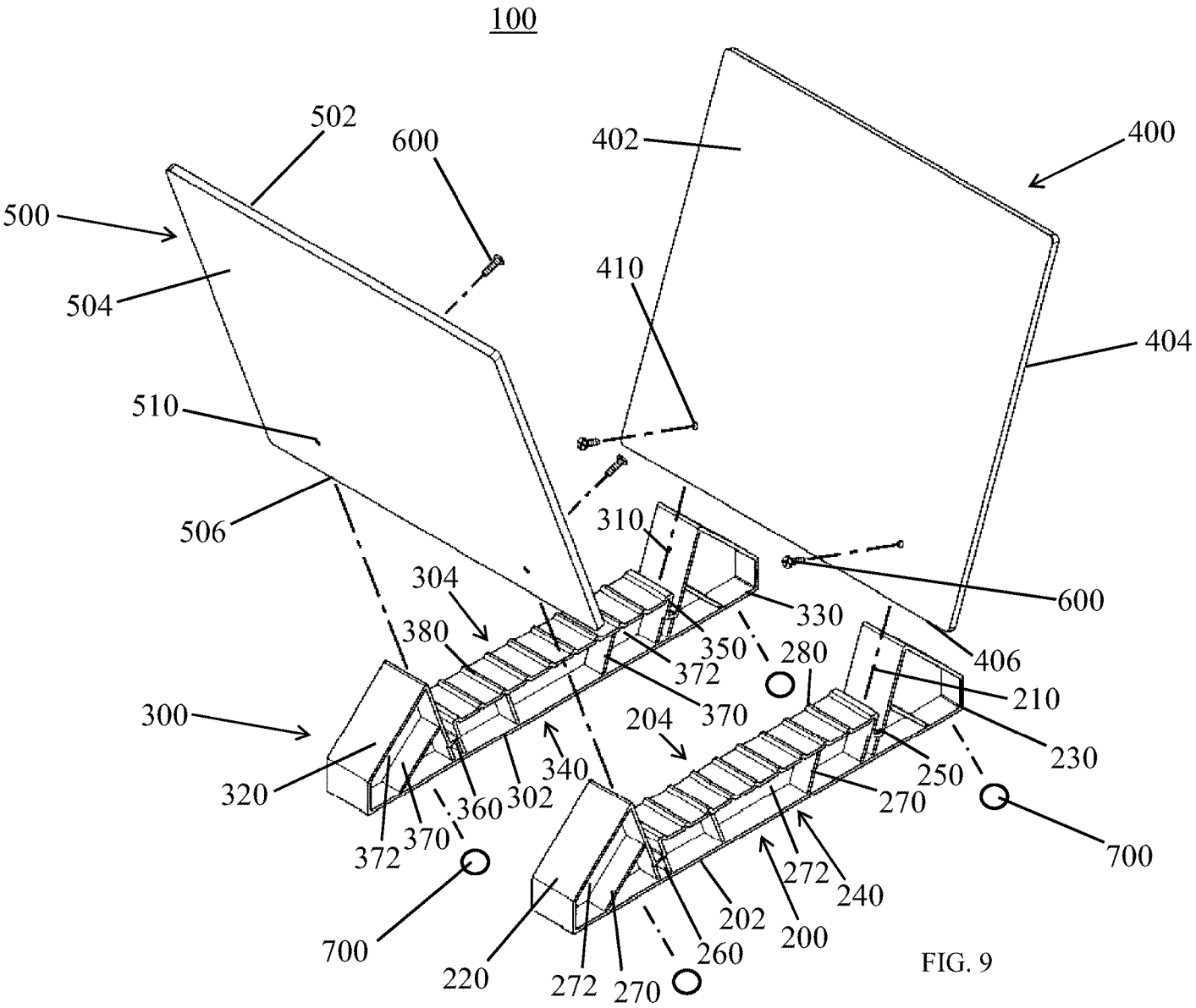
FIG. 9 is an exploded view of the album holder of FIG. 1.

Referring now to FIGS. 1-10, there is illustrated a non-limiting embodiment of an the album holder 100 includes first and second base legs 200, 300, front and back panels 400, 500, optional connectors 600, and optional pads 700. As best illustrated in FIG. 9, the shape, size and configuration of the first and second base legs 200, 300 is generally the same. Likewise, the shape, size and configuration of the front and back panels 400, 500 is generally the same. The material used to form the first and second base legs 200, 300 is generally the same, and can optionally be a plastic material (e.g., PVC, etc.). The material used to form the front and back panels 400, 500 is generally the same (e.g., plastic material [e.g. acrylic, etc.], etc.). The front and back panels 400, 500 can optionally be semi-opaque or clear; however, this is not required.

As best illustrated in FIG. 9, the first and second base legs 200, 300 include a bottom surface 202, 302, a top surface 204, 304, preformed base openings 210, 310, front end sections 220, 320, back end sections 230, 330, mid sections 240, 340, front panel mount slot 250, 350, back panel mount slot 260, 360, reinforcement ribs 270, 370, and album ribs 280, 380. The first and second base legs 200, 300 are illustrated as being formed of a single piece of material; however, this is not required.

The mid sections 240, 340 are positioned between the front end sections 220, 320, back end sections 230, 330. The top surface of the mid sections 240, 340 incudes a plurality (e.g., 2-20 and all values and ranges therebetween) of album ribs 280, 380. The adjacent album ribs 280, 380 are illustrated as having a generally equal size and shape and being equally spaced from one another; however, this is not required. Generally the album ribs 280, 380 are spaced about 0.4-2 inches apart (and all values and ranges therebetween), and typically the album ribs 280, 380 are spaced about 0.5-1 inches apart. The height of the album ribs 280, 380 is generally about the same; however, this is not required. Generally, the height of the album ribs 280, 380 is about 0.05 to 0.4 inches (and all values and ranges therebetween), and typically the height of the album ribs 280, 380 is about 0.1 to 0.25 inches. The one or more album ribs 280, 380 are used to a) inhibit or prevent the albums A from sliding fully along the longitudinal length of the mid sections 240, 340, and/or b) facilitate in the pivoting of the albums A on the top surface of the mid sections 240, 340 when a user is search or reviewing the albums A in the album holder 100. The mid sections 240, 340 generally have a longitudinal length to enable at least two (2) albums, and typically 2-100 albums (and all values and ranges therebetween) to be positioned on the mid sections 240, 340.

The front face of the front end sections 220, 320 and the back end sections 230, 330 each include the preformed base openings 210, 310. As discussed in more detail below, the preformed base openings 210, 310 are configured to receive a portion of the connectors 600. The preformed base openings 210, 310 are positioned on the preformed base openings 210, 310 such that the preformed base openings 210, 310 are higher than the top surface of the mid sections 240, 340.

Positioned between the front end sections 220, 320 and the back end sections 230, 330 and the mid sections 240, 340 are the front panel mount slot 250, 350 and the back panel mount slot 260, 360. The front panel mount slot 250, 350 and the back panel mount slot 260, 360 are configured to receive a portion of the bottom region of the front and back panels 400, 500 when the front and back panels 400, 500 are being connected to the first and second base legs 200, 300.

The longitudinal length of the mid sections 240, 340 is greater than each of the front end sections 220, 320 and the back end sections 230, 330. The maximum height of the mid sections 240, 340 is less than a maximum height of each of the front end sections 220, 320 and the back end sections 230, 330. The maximum width of the mid sections 240, 340 is generally the same as the maximum width of each of the front end sections 220, 320 and the back end sections 230, 330.

The thickness of each of the front panel mount slot 250, 350 and the back panel mount slot 260, 360 is the same or slightly greater (e.g., 0.1% to 10% greater and all values and ranges therebetween) than the thickness of the bottom region of the front and back panels 400, 500 that is to be positioned in the front panel mount slot 250, 350 and the back panel mount slot 260, 360. Generally the depth of the front panel mount slot 250, 350 and the back panel mount slot 260, 360 measured as the distance below the top surface of the mid sections 240, 340 is a) at least 0.1 inches, typically 0.1 to 2 inches (and all values and ranges therebetween), and typically 0.2-1 inches, and/or b) at least 5% an average height of each of the mid sections 240, 340, typically 10-90% (and all values and ranges therebetween) an average height of each of the mid sections 240, 340.

The shape, size and configuration of the front panel mount slot 250, 350 and the back panel mount slot 260, 360 are generally the same. The side profile of the front panel mount slot 250, 350 and the back panel mount slot 260, 360 is generally U-shaped. The bottom surface of each the front panel mount slot 250, 350 and the back panel mount slot 260, 360 is generally flat; however, this is not required.

As illustrated in FIGS. 1, 4, 5 and 8-10, the front face of the front end sections 220, 320 and the back end sections 230, 330 angle rearwardly from the mid sections 240, 340 such that when the front and back panels 400, 500 are connected to the first and second base legs 200, 300, the front and back panels 400, 500 slope away from one another. In one non-limiting embodiment, the plane of the front face of one or both the front end sections 220, 320 and the back end sections 230, 330 relative to the plane of the bottom surface 202 of the first and second base legs 200, 300 is at least 5°, and typically about 30-75° (and all values and ranges therebetween). When the inner panel face of one or both of the front and back panels 400, 500 is positioned against the front face of the front end sections 220, 320 and the back end sections 230, 330 when connecting the front and back panels 400, 500 to the first and second base legs 200, 300, the plane of the inner panel face of the front and back panels 400, 500 has an angle relative to the plane of the bottom surface 202 of the first and second base legs 200, 300 that is the same or similar to the plane of the front face of one or both the front end sections 220, 320 and the back end sections 230, 330 relative to the plane of the bottom surface 202 of the first and second base legs 200, 300. In another non-limiting embodiment, the plane of the inner panel face and outer panel face of one or both of the front and back panels 400, 500 are parallel to on another. In another non-limiting embodiment, when the inner panel face of one or both of the front and back panels 400, 500 is positioned against the front face of the front end sections 220, 320 and the back end sections 230, 330 when connecting the front and back panels 400, 500 to the first and second base legs 200, 300, the plane of the inner panel face of the front and back panels 400, 500 has an angle relative to the plane of the bottom surface 202 of the first and second base legs 200, 300 that is the same or opposite by 180° (depending on how the angles are measure relative to the bottom surface 202 of the first and second base legs 200, 300).

The top edge of the front end sections 220, 320 and the back end sections 230, 330 is illustrated as being above the top surface of the mid sections 240, 340. In one non-limiting embodiment, top edge of the front end sections 220, 320 and the back end sections 230, 330 is a) about 0.5-5 inches (and all values and ranges therebetween) above the top surface of the mid sections 240, 340, and typically about 0.5-2 inches above the top surface of the mid sections 240, 340, orb) about 10-500% (and all values and ranges therebetween) greater than the height of the one of the mid sections 240, 340. The height and width of the front face of the front end sections 220, 320 and the back end sections 230, 330 provides support and stability of to the front and back panels 400, 500 when the front and back panels 400, 500 are connected to the first and second base legs 200, 300. The front face of the front end sections 220, 320 and the back end sections 230, 330 is generally a flat surface; however, this is not required. The width of the front face of the front end sections 220, 320 and the back end sections 230, 330 is generally the same as the width of the mid sections 240, 340.

The front end sections 220, 320 and the back end sections 230, 330 are illustrated as including one or more support structures in the form of reinforcement ribs 270, 370 and reinforcement walls 272, 372. The reinforcement walls 272, 372 are illustrated as extending from the bottom to the top of the front end sections 220, 320 and the back end sections 230, 330. The reinforcement ribs 270, 370 are illustrated as extending from the bottom to a side of the front end sections 220, 320 and the back end sections 230, 330. As can be appreciated, the reinforcement ribs 270, 370 and reinforcement walls 272, 372 can other or additional configurations to create rigidity and/or strength to the front end sections 220, 320 and the back end sections 230, 330. The reinforcement ribs 270, 370 and/or reinforcement walls 272, 372 are spaced form the outer side edge of the front end sections 220, 320 and the back end sections 230, 330; however, this is not required.

The mid sections 240, 340 are also illustrated as including one or more support structures in the form of reinforcement ribs 270, 370 and reinforcement walls 272, 372. The reinforcement walls 272, 372 are illustrated as extending from the bottom to the top of the mid sections 240, 340. The reinforcement ribs 270, 370 are also illustrated as extending from the bottom to a top of the mid sections 240, 340. As can be appreciated, the reinforcement ribs 270, 370 and reinforcement walls 272, 372 can other or additional configurations to create rigidity and/or strength to the mid sections 240, 340. The reinforcement ribs 270, 370 and/or reinforcement walls 272, 372 are spaced form the outer side edge of the mid sections 240, 340; however, this is not required.

Referring again to FIGS. 1-10, the front and back panels 400, 500 have a front surface 402, 502 and a back surface 404, 504. The shape of each of the front and back panels 400, 500 is generally square or rectangular shape. The bottom portion of each of the front and back panels 400, 500 include two preformed connector openings 410, 510. The preformed connector openings 410, 510 are generally spaced from the bottom edge 406, 506 of the front and back panels 400, 500. The preformed connector openings 410, 510 are each generally spaced the same distance from the bottom edge 406, 506 of the front and back panels 400, 500;

however, this is not required. The size and shape of the preformed connector openings 410, 510 is non-limiting. The size and shape of the preformed connector openings 410, 510 on the front and back panels 400, 500 is generally the same; however, this is not required.

The one or more corners and/or edges of the front and back panels 400, 500 can optionally be rounded, beveled, chamfered, etc. to reduce or eliminate sharp corners and/or edges on the front and back panels 400, 500. The thickness of the panels is generally less than 0.5 inches; however, this is not required. Generally the front and back panels 400, 500 have a uniform thickness; however, this is not required. Generally the front and back panels 400, 500 each have a length of about 4-15 inches (and all values and ranges therebetween) and a width of about 4-15 inches (and all values and ranges therebetween).

Figure 6:
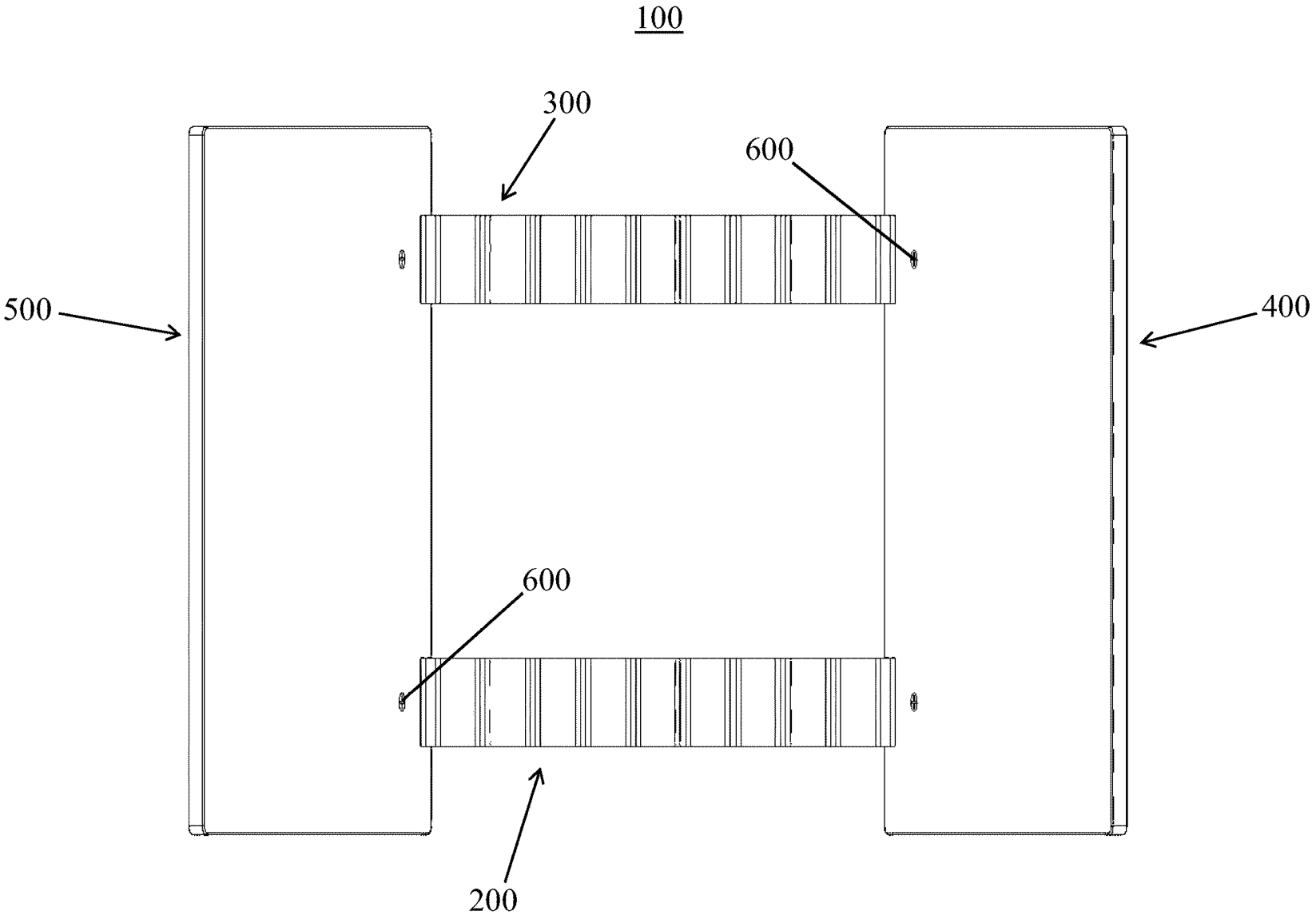
FIG. 6 is a top plan view of the album holder of FIG. 1.
Figure 7:
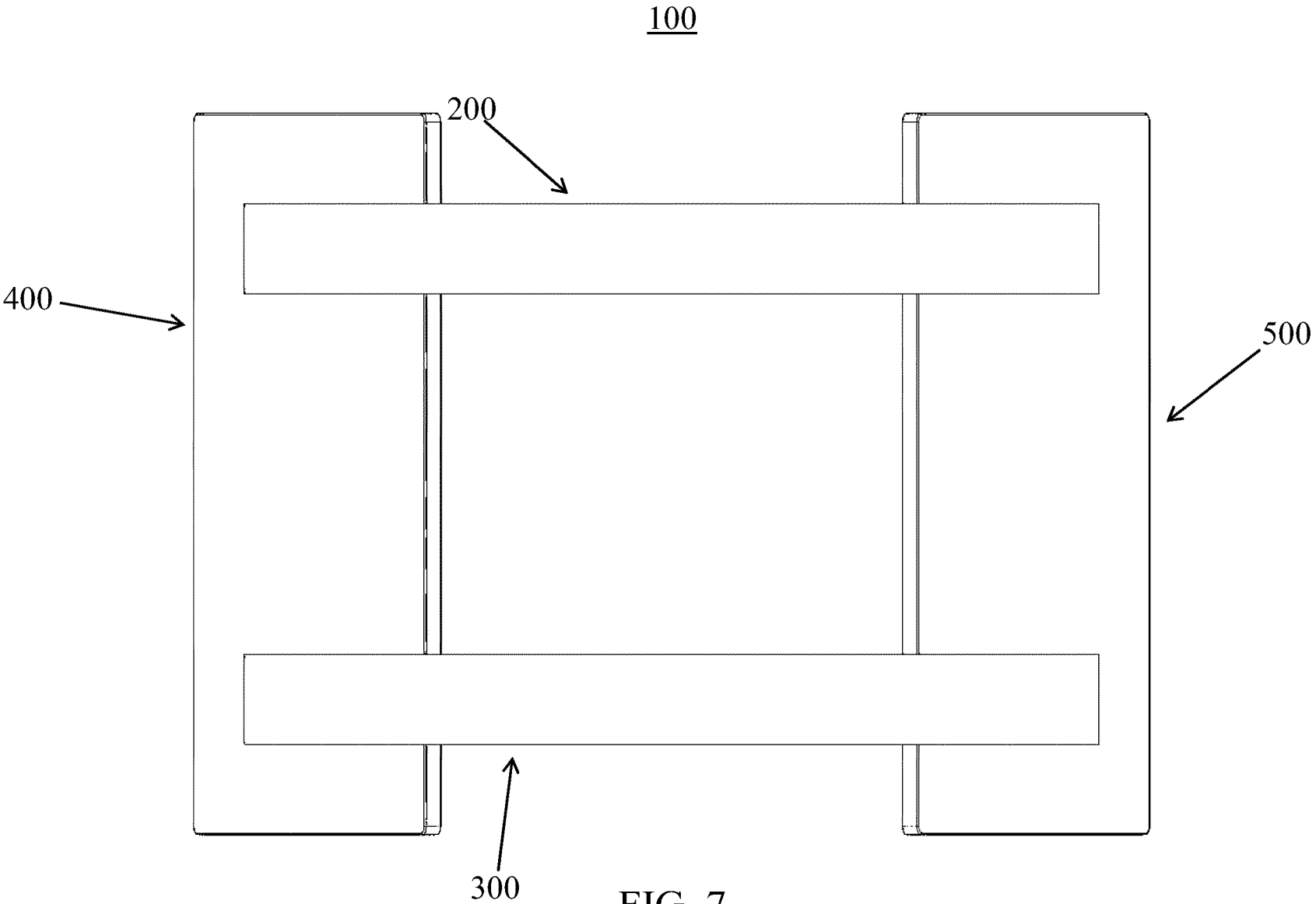
FIG. 7 is a bottom plan view of the album holder of FIG. 1.

The optional connectors 600 are illustrated as being screws; however, other types of connectors can be used. As best illustrated in FIG. 9, two screws are used to secure each of the front and back panels 400, 500 to the first and second base legs 200, 300; however, it can be appreciated, that more than two screws can be used. During the connection of the front and back panels 400, 500 to the first and second base legs 200, 300, each screw is first partially inserted through preformed connector openings 410, 510 on the front and back panels 400, 500. Thereafter, the screw is further inserted through the preformed connector openings 410, 510 on the front and back panels 400, 500 until the screw engage and are inserted into the preformed base openings 210, 310 in the first and second base legs 200, 300. Once the screws are properly inserted into the preformed connector openings 410, 510 preformed base openings 210, 310, the front and back panels 400, 500 are secured to the first and second base legs 200, 300. The removal of the screws from the front and back panels 400, 500 to the first and second base legs 200, 300 will result in from and back panels 400, 500 being able to be disconnected from the front and back panels 400, 500 to the first and second base legs 200, 300. The shape of the preformed connector openings 410, 510 on the front and back panels 400, 500 can be shaped such that when the screw is in its final connection position, the head of the screw is flush with the front surface 402, 502 of the front and back panels 400, 500 as illustrated in FIGS. 1, 6 and 8, or slightly recessed from the front surface 402, 502 of the front and back panels 400, 500 so that the head of the screws do not damage the album covers of the albums A that are positioned on the album holder 100.

Referring now to FIG. 8, the optional pads 700 are illustrated as covering only a portion of a bottom surface 202, 302 of the first and second base legs 200, 300 when the pads are connected to the first and second base legs 200, 300. The pads 700 can be in the form of a felt material; however, other materials can be used. Generally, the thickness of the pads 700 is less than 0.25 inches. The pads 700 are illustrated has having a circular shape; however, this is not required. The pads 700 are generally secured to the bottom surface of the first and second base legs 200, 300 by use of an adhesive; however, other connection arrangements can be used. The pads 700, when used, can be used be to a) inhibit or prevent the bottom surface 202, 302 of the first and second base legs 200, 300 from scratching a surface that the first and second base legs 200, 300 were placed upon, and/or b) inhibiting or preventing the bottom surface 202, 302 of the first and second base legs 200, 300 from moving or sliding on a surface that the first and second base legs 200, 300 were placed upon.

Figure 10:
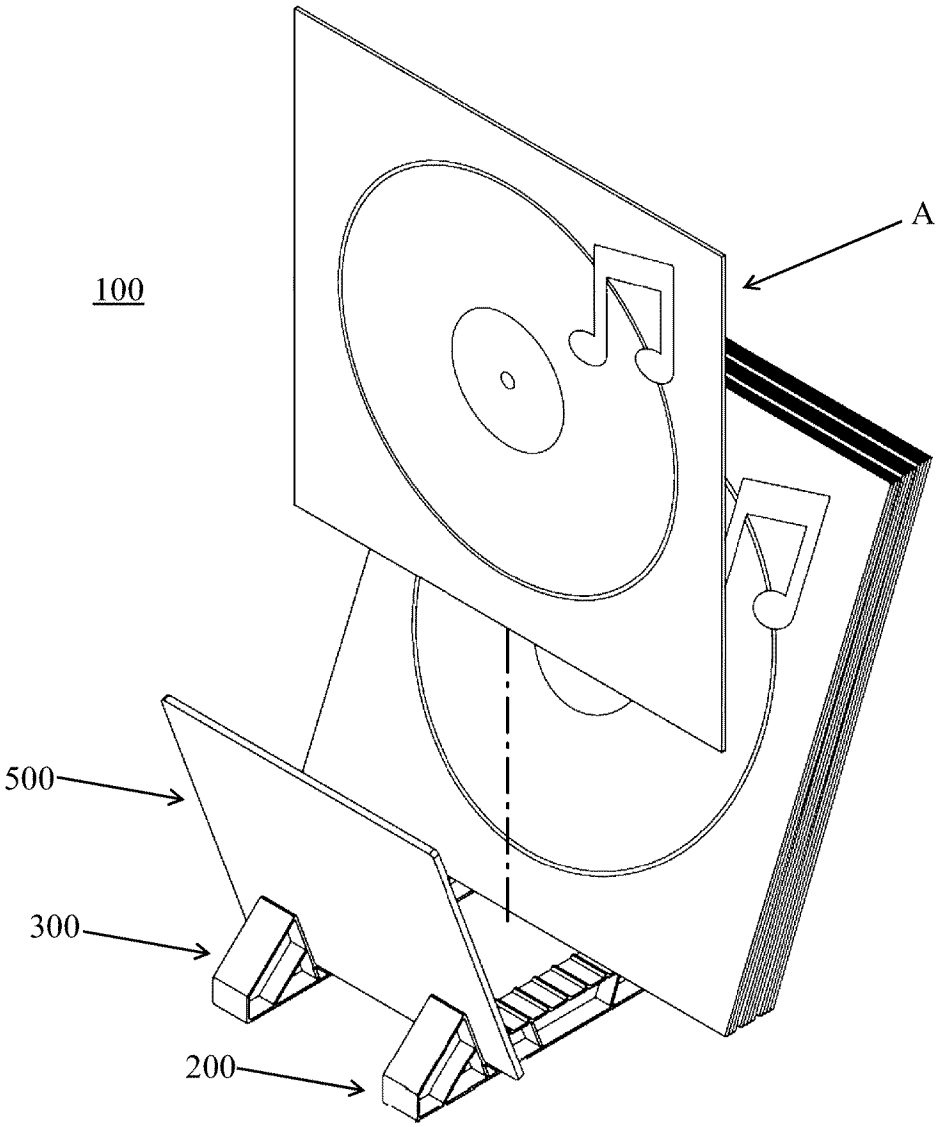
FIG. 10 is a front elevation view of the album holder of FIG. 1 that includes a plurality of albums on the album holder.

During use, one or more albums A are placed on the album holder 100 as illustrated in FIG. 10. When a user is reviewing the albums A in the album holder 100, the use can grasp the top portion of an album A and then pivot the album A while is remains in the album holder A so that the use can view both sides of the cover of the album A without having the remove the album A form the album holder 100. The album ribs 280, 380 on the first and second base legs 200, 300 inhibit or prevent the bottom of the album A from sliding along the length of the mid sections 240, 340 as the album A is being pivoted on the album holder 100 by the user. The album holder 100 is configure to allow a use to simply lift an album A off the album holder 100 when the user want to use the album A and also simply inset the album A back into the album holder 100 when the user wants to again store the album A in the album holder 100. No assembly or disassembly of the album holder 100 is required when inserting and removing the album A from the album holder 100.

To aid the Patent Office and any readers of this application and any resulting patent in interpreting the claims appended hereto, Applicant does not intend any of the appended claims or claim elements to invoke 35 U.S.C. 112(f) unless the words "means for" or "step for" are explicitly used in the particular claim.

It will thus be seen that the objects set forth above, among those made apparent from the preceding description, are efficiently attained, and since certain changes may be made in the constructions set forth without departing from the spirit and scope of the disclosure, it is intended that all matter contained in the above description and shown in the accompanying drawings shall be interpreted as illustrative and not in a limiting sense. The disclosure has been described with reference to preferred and alternate embodiments. Modifications and alterations will become apparent to those skilled in the art upon reading and understanding the detailed discussion of the disclosure provided herein. This disclosure is intended to include all such modifications and alterations insofar as they come within the scope of the present disclosure. It is also to be understood that the following claims are intended to cover all of the generic and specific features of the disclosure herein described and all statements of the scope of the disclosure, which, as a matter of language, might be said to fall there between. The disclosure has been described with reference to the preferred embodiments. These and other modifications of the preferred embodiments as well as other embodiments of the disclosure will be obvious from the disclosure herein, whereby the foregoing descriptive matter is to be interpreted merely as illustrative of the disclosure and not as a limitation. It is intended to include all such modifications and alterations insofar as they come within the scope of the appended claims.

What is claimed:

1. An album holder comprising:

first and second base legs; each of said first and second base legs includes a front end section, a back end section and a mid-section positioned between said front end section and said back end section; a top surface of said mid-section including a plurality of ribs; said front end section of said first and second base legs include a rearwardly sloped surface;

front and back panels; and a connection arrangement fixably securing with a front panel fastener arrangement said front panel to said rearwardly sloped surface of said front end section of said first and second base legs such that said front panel cannot move along a longitudinal length of said first and second base legs; and wherein a front face of said front panel is configured to angle away from a front face of said back panel when said front panel is fixably secured to said first and second base legs; and wherein at least a portion of a back face of said front panel contacting at least a portion of said rearwardly sloped surface of said front end section of each of said first and second base legs.

2. The album holder as defined in claim 1, wherein each of said first and second base legs includes one or more reinforcement structures.

3. The album holder as defined in claim 1, wherein said mid-section includes one or more reinforcement structures.

4. The album holder as defined in claim 1, wherein said back panel is fixably secured by a back panel fastener arrangement to a rearwardly sloped surface on said back end section of said first and second base legs.

5. The album holder as defined in claim 1, wherein each of said first and second base legs includes preformed base openings in a front face of each of said front end sections and said back end section of each of said first and second base legs.

6. The album holder as defined in claim 1, wherein said first and second base legs are spaced from one another along a complete longitudinal length of said first and second base legs when said front and back panels are connected to said first and second base legs; said front and back panels are the only structures securing said first and second base legs in position relative to one another.

7. The album holder as defined in claim 1, wherein said first and second base legs each include a front panel mount slot and a back panel mount slot; said front panel mount slot and said back panel mount slot are each configured to receive a portion of a bottom region of said front and back panels when said front and back panels are positioned on said first and second base legs.

8. The album holder as defined in claim 7, wherein a side profile of said front panel mount slot and said back panel mount slot is generally U-shaped.

9. The album holder as defined in claim 7, wherein a thickness of each of said front panel mount slot and said back panel mount slot is the same or slightly greater than a thickness of a bottom region of said front and back panels that is positioned in said front panel mount slot and said back panel mount slot.

10. The album holder as defined in claim 7, wherein each of said front panel mount slot and said back panel mount slot extends below a top surface of said mid-section.

11. The album holder as defined in claim 1, wherein a longitudinal length of said mid-section of each of said first and second base legs is greater than a longitudinal length of each of said front end sections and said back end sections.

12. The album holder as defined in claim 1, wherein maximum height of said mid sections of each of said first and second base legs is less than a maximum height of each of said front end sections and said back end sections.

13. The album holder as defined in claim 1, wherein said front and back panels have a same shape and size; said first and second base legs each have a same shape and size.

14. The album holder as defined in claim 1, wherein each of said front and back panels include a plurality of preformed connector openings; each of said preformed connector openings are spaced from a bottom edge of said front and back panels.

15. The album holder as defined in claim 1, wherein a bottom surface each of said first and second base legs includes a pad; said pad used to a) inhibit or prevent said bottom surface of said first and second base legs from scratching a surface that said first and second base legs are placed upon, and/or b) inhibiting or preventing said bottom surface of said first and second base legs from moving or sliding on a surface that said first and second base legs are were placed upon.

* * * * *